US010167577B2

(12) United States Patent
Krohmer et al.

(10) Patent No.: US 10,167,577 B2
(45) Date of Patent: Jan. 1, 2019

(54) CHANNEL PLATE ADAPTER AND OPEN-END SPINNING DEVICE WITH A CHANNEL PLATE ADAPTER

(71) Applicant: Maschinenfabrik Rieter AG, Winterhur (CH)

(72) Inventors: Siegfried Krohmer, Beuren (DE); Helmut Wollinger, Bad Ditzenbach (DE)

(73) Assignee: Maschinenfabrik Rieter AG, Winterthur (CH)

( * ) Notice: Subject to any disclaimer, the term of this patent is extended or adjusted under 35 U.S.C. 154(b) by 115 days.

(21) Appl. No.: 15/271,509

(22) Filed: Sep. 21, 2016

(65) Prior Publication Data

US 2017/0081789 A1 Mar. 23, 2017

(30) Foreign Application Priority Data

Sep. 21, 2015 (DE) ..... 10 2015 115 912

(51) Int. Cl.
*D01H 4/38* (2006.01)
*D01H 4/40* (2006.01)

(52) U.S. Cl.
CPC ..... *D01H 4/38* (2013.01); *D01H 4/40* (2013.01)

(58) Field of Classification Search
CPC .. D01H 4/38; D01H 4/08; D01H 4/10; D01H 4/12; D01H 4/14
USPC ..... 57/404
See application file for complete search history.

(56) References Cited

U.S. PATENT DOCUMENTS 3,523,300 A * 8/1970 Shinkai ..... D01H 4/08 57/409
3,538,698 A 11/1970 Ripka et al.
3,651,632 A * 3/1972 Shepherd ..... D01H 4/08 57/404
3,672,144 A * 6/1972 Didek ..... D01H 4/08 57/413

(Continued)

FOREIGN PATENT DOCUMENTS

DE 37 34 544 A1 5/1989
DE 43 09 704 C1 7/1994

(Continued)

OTHER PUBLICATIONS

German Search Report, dated Jun. 24, 2016.
EP Search Report, dated Feb. 9, 2017.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

A channel plate adapter is provided for use in a cover of a rotor housing of an open-end spinning device, wherein a rotor is rotatably arranged in the rotor housing. The channel plate adapter includes an output fiber channel that conveys fibers to the rotor, the output fiber channel having an inlet side where fibers enter and an outlet side from which the fibers exit towards the rotor. The output fiber channel further includes a bend between the inlet side and the outlet side, the bend splitting the output fiber channel into a first section formed between the inlet side and the bend, and a second section formed between the bend and the outlet side. The bend changes direction of the second section relative to the first section such that the second section is oriented against a direction of rotation of the rotor.

13 Claims, 2 Drawing Sheets

(56) References Cited

U.S. PATENT DOCUMENTS

| | | | | | |
|---|---|---|---|---|---|
| 3,956,876 | A * | 5/1976 | Artzt | D01H 4/08 | 57/413 |
| 4,014,162 | A * | 3/1977 | Stahlecker | D01H 4/08 | 57/412 |
| 4,058,963 | A * | 11/1977 | Stahlecker | D01H 4/24 | 57/302 |
| 4,245,460 | A * | 1/1981 | Staufert | D01H 4/08 | 57/302 |
| 4,393,648 | A * | 7/1983 | Rambousek | D01H 4/40 | 57/413 |
| 4,567,723 | A * | 2/1986 | Safar | D01H 7/92 | 57/404 |
| 4,676,059 | A * | 6/1987 | Artzt | D01H 4/48 | 57/263 |
| 5,065,572 | A * | 11/1991 | Stahlecker | D01H 4/38 | 57/408 |
| 5,111,651 | A * | 5/1992 | Pohn | D01H 4/38 | 57/411 |
| 5,471,829 | A | 12/1995 | Billner | | |
| 5,488,822 | A * | 2/1996 | Meier | D01H 4/38 | 57/406 |
| 5,535,580 | A * | 7/1996 | Sebastian | D01H 4/50 | 57/263 |
| 5,581,991 | A * | 12/1996 | Billner | D01H 4/08 | 57/413 |
| 5,595,058 | A * | 1/1997 | Billner | D01H 4/08 | 57/412 |
| 5,598,695 | A * | 2/1997 | Kaneko | D01H 4/08 | 57/413 |
| 5,640,838 | A * | 6/1997 | Billner | D01H 4/08 | 57/263 |
| 5,687,558 | A * | 11/1997 | Stahlecker | D01H 4/08 | 57/411 |
| 5,694,756 | A * | 12/1997 | Lindner | D01H 4/44 | 57/263 |
| 5,778,654 | A * | 7/1998 | Stahlecker | D01H 4/08 | 57/407 |
| 5,867,975 | A * | 2/1999 | Breitenhuber | D01H 4/50 | 57/263 |
| 5,901,546 | A * | 5/1999 | Lovas | D01H 4/08 | 57/408 |
| 5,916,119 | A * | 6/1999 | Lovas | D01H 4/24 | 57/263 |
| 6,047,538 | A * | 4/2000 | Wassenhoven | D01H 4/38 | 57/406 |
| 6,105,355 | A * | 8/2000 | Winzen | D01H 4/08 | 57/406 |
| 6,295,800 | B1 * | 10/2001 | Stahlecker | D01H 4/38 | 57/406 |
| 6,314,712 | B1 * | 11/2001 | Thierron | D01H 4/50 | 57/263 |
| 7,347,040 | B2 * | 3/2008 | Voidel | D01H 4/38 | 57/408 |
| 7,493,749 | B2 * | 2/2009 | Stalder | D01H 1/115 | 57/350 |
| 2007/0169460 | A1 | 7/2007 | Wassenhoven | | |

FOREIGN PATENT DOCUMENTS

| | | | |
|---|---|---|---|
| DE | 43 07 785 | A1 | 9/1994 |
| DE | 195 44 617 | A1 | 6/1997 |
| DE | 196 32 888 | A1 | 2/1998 |
| DE | 102 10 895 | A1 | 9/2003 |
| DE | 103 48 710 | A1 | 5/2005 |
| DE | 10 2008 050 071 | A1 | 4/2010 |
| DE | 10 2009 012 045 | A1 | 9/2010 |
| EP | 0 311 988 | A1 | 4/1989 |
| EP | 0 979 888 | A1 | 2/2000 |
| WO | WO 2005/100652 | A1 | 10/2005 |

* cited by examiner

CHANNEL PLATE ADAPTER AND OPEN-END SPINNING DEVICE WITH A CHANNEL PLATE ADAPTER

FIELD OF THE INVENTION

The present invention relates to a channel plate adapter for use in a cover of a rotor housing of an open-end spinning device, whereas a rotor is rotatably arranged in the rotor housing. The channel plate adapter comprises an output fiber channel, which conveys fibers to the rotor, whereas the fibers enter at an inlet side of the output fiber channel, from which the fibers exit at an outlet side of the output fiber channel to the rotor.

BACKGROUND

A fiber guide channel for the pneumatic transport of individual fibers is known from DE 103 48 710 A1. The individual fibers are combed out from a fed fiber sliver by an opening roller of an open-end spinning device rotating in an opening roller housing. They are transported to a spinning rotor circulating with a high rotational speed in a rotor housing that is subject to negative pressure, whereas the fiber guide channel arranged in a cover element for closing the rotor housing on the input side is matched to the mounting of the opening roller with respect to its width. In this case, the inlet opening and the outlet opening of the fiber guide channel feature a slot-like shape, whereas the maximum extension of the inlet opening extends parallel to the axis of rotation of the opening roller, and the maximum extension of the outlet opening of the fiber guide channel, with respect to the maximum extension of the inlet opening, is arranged in a rotating manner by 90°+/−10° around a longitudinal axis of the fiber guide channel. Herein, the fiber guide channel is curved and is twisted. One disadvantage in this is that such a curved fiber guide channel is difficult to manufacture. In addition, fiber quality is not sufficiently increased with such a fiber guide channel.

SUMMARY OF THE INVENTION

Thus, a task of the present invention is to provide a fiber channel that improves quality of a yarn of a spinning machine. Additional objects and advantages of the invention will be set forth in part in the following description, or may be obvious from the description, or may be learned through practice of the invention.

The tasks are solved by a channel plate adapter for use in a cover of a rotor housing of an open-end spinning device and an open-end spinning device with the characteristics as described above.

A channel plate adapter for use in a cover of a rotor housing of an open-end spinning device is proposed. At this, a rotor is rotatably arranged in the rotor housing.

The rotor serves the purpose of forming a yarn from individual fibers. For this purpose, the fibers are introduced into the rotor through a single rotor opening of the rotor. In an axial direction of the rotor, a rotor base is arranged in a manner spaced from the rotor opening, which delimits an inner space of the rotor in an axial direction. A rotor wall is arranged at a circumference of the rotor; this features a fiber-collecting groove, which is formed with a radius that is greater than that of the rotor wall. Through rotation of the rotor, the fibers are, on the one hand, taken up by the rotor and/or accelerated to the rotational speed of the rotor. Thereby, the fibers initially meet an inner side of the rotor wall. Due to the rotation, on the other hand, centrifugal forces are formed, which guide the fibers along the rotor wall into the fiber-collecting groove. In the fiber-collecting groove, the individual fibers are connected into a yarn, which is withdrawn from the rotor and wound onto a bobbin.

The individual fibers may come from an opening roller, which combs out the individual fibers from a fiber strand.

In order to guide the fibers to the rotor, the channel plate adapter has an output fiber channel, which guides the fibers coming from the direction of the opening roller through the rotor opening into the rotor. With the output fiber channel, the fibers can be introduced into the rotor in a defined manner. For example, with the output fiber channel, the speed of the fibers entering the rotor can be determined.

For this purpose, the output fiber channel features an inlet side, at which the individual fibers enter the output fiber channel, and an outlet side, at which the individual fibers exit from the output fiber channel to the rotor. At this, the outlet side of the output fiber channel is spaced from the rotor wall. This distance is in the range of a few millimeters, for example in the range of 1 mm-4 mm.

In accordance with the invention, the output fiber channel features a bend between the inlet side and the outlet side. The bend splits the output fiber channel into a first section, which is formed between the inlet side and the bend, and a second section, which is formed between the bend and the outlet side. Thus, the fibers flow initially through the first section of the output fiber channel and then through the second section of the output fiber channel. Herein, the bend bends the second section of the output fiber channel in respect of the first section, in such a manner that the second section is bent or deflected against the direction of rotation of the rotor.

The channel plate adapter features a substantially cylindrical or slightly conical base body, on which, however, various extensions that are required for functional or structural reasons can be formed. Herein, the output fiber channel passes through the base body obliquely to the central axis of the base body and opens into the shell surface of the base body near one front side of the base body. The front side of the base body, on which the output fiber channel opens, forms an inner side of the channel plate adapter, while the front side of the base body opposite to the inner side forms an outer side of the channel plate adapter. Since the rotor typically rotates to the right seen from the outer side of the spinning device or seen from the opening of the rotor, the bend may also thus be described as bent to the left when seen from the outer side of the channel plate adapter.

With a further embodiment, it may be that the bend redirects the second section in such a manner that it is inclined away from an axis of rotation of the rotor.

In the state of the art, there is typically an attempt to lead the output fiber channel as tangentially as possible to the rotor wall. This leads to the fact that the individual fibers also tangentially impinge on the rotor wall, and thus experience only a slight change of direction when impinging on the rotor wall. That is intended to prevent (for example) the individual fibers from buckling when striking the rotor wall. In addition, the individual fibers thereby accelerate to the, or at least approximately to the, speed of the rotor wall.

However, if the second section of the output fiber channel is bent against the direction of rotation of the rotor by means of the bend, this results in the fact that the second section of the output fiber channel is located on the rotor wall at a more steep or "more perpendicular" angle. In this case, the individual fibers cannot be accelerated as strongly as when the fibers are fed tangentially. This has the effect that, upon an exit of the individual fibers from the outlet side of the output fiber channel, a front part of the individual fibers initially comes into contact with the rotor wall, and is pulled along or accelerated by this. The rotor wall features a higher (rotational) speed than the individual fibers in the output fiber channel, and in particular higher than the fibers in the second section of the output fiber channel. Thus, the front part of the fibers impinging on the rotor wall is accelerated by the faster moving rotor wall, while a rear part of the individual fibers is still in the output fiber channel, and in particular features a lower speed than the rotor wall. In addition, the speed of the rear part of the individual fibers is particularly less than the speed of the front part of the individual fibers. Such a difference in speed, or such a higher acceleration of the front part of the individual fibers relative to the rear part of the individual fibers, leads to a drawing of the individual fibers. In doing so, any unevenness can be drawn out from the individual fibers. After such a drawing process, the individual fibers feature a greater uniformity, and form a yarn with a higher yarn quality, wherein tensile strength is increased.

In addition, the bend has another effect. Due to the bend, the individual fibers are no longer guided straight through the output fiber channel, but meet, in particular in the second section, after the bend on an inner wall of the output fiber channel. In doing so, the individual fibers slide along up to the outlet side of such inner wall. This generates friction between the individual fibers and the inner wall, which further inhibits the acceleration of the individual fibers. Thereby, a difference in speed between the front part of the individual fibers, which are already accelerated by the rotor, and the rear part of the individual fibers, which are inhibited by the friction between the fibers and the inner wall in their acceleration, is greater, such that the individual fibers are drawn even more. Thus, the fibers arrive in the rotor with a particularly good drawing or straightness, whereby they are spun into a yarn with a higher quality.

A third effect arises, since, when exiting the output fiber channel at the outlet side, the individual fibers are pulled over an edge between the outlet side and the inner wall, on which the fibers slide along. In doing so, the inner wall on which the individual fibers slide along and the rotor wall may feature an angle. When exiting the output fiber channel, the individual fibers are deflected by such an angle. In this case, the individual fibers are pulled over the edge at this angle, such that any irregularities arising from the individual fibers are smoothed out.

An advantageous additional form of the invention is for the channel plate adapter to feature a draw-off element, by means of which a yarn formed by the rotor can be led out of the rotor. The draw-off element may feature, for example, a draw-off nozzle. The draw-off element may be arranged, for example, coaxially to the axis of rotation of the rotor, such that the finished yarn is able to be drawn off from the center of the rotor.

Furthermore, it is advantageous if the first section of the output fiber channel, which is formed between the bend and the inlet side, encloses an angle between 170° and 179° to the second section. In particular, the angle may have values of between 173° and 177°. Preferably, the angle may also have a value of 175.6°. With such an angle, on the one hand, a favorable feeding of the fibers to the rotor wall with the above-described effect of drawing is achieved, and, on the other hand, an unfavorable striking of the individual fibers on the inner wall of the output fiber channel in the area of the bend is avoided. Just such an angle leads to the fact that the individual fibers flow against the inner wall in the proper scope, and at that point slide along the inner wall to the outlet side.

It is also advantageous if the output fiber channel is bent between the inlet side and the outlet side in such a manner that the second section is inclined in the direction of the rotor base. Thus, with respect to the first section, the second section is not only bent in the radial direction of the base body of the channel plate adapter, but is also bent in an additional direction, in particular in the axial direction of the base body. In doing so, the fibers can be more easily introduced into the rotor. In particular, the fibers obtain a speed component that is directed away from the rotor opening and to the rotor base. Thus, the fibers are securely fed to the rotor wall. For this purpose, the output fiber channel features (for example) a second bend, which is (for example) orthogonal to the first bend in accordance with the invention; that is, the second bend bends the output fiber channel, for example, only in one plane, and the first bend bends the output fiber channel solely in one orthogonal plane. In addition, the second bend may be arranged at any point between the inlet side and the outlet side. In doing so, the second bend may also be arranged at the same point as the first bend.

It is also advantageous if the second section is inclined with respect to the first section of the output fiber channel at an angle between 1° and 25° in the direction of the rotor base. In particular, the angle may be between 3° and 15°. Thus, the fibers can be reliably introduced into the rotor, such that they remain in it and do not escape back through the rotor opening.

It is also advantageous if the output fiber channel is formed in a tapered manner from the inlet side to the outlet side. Thereby, the flow speed of the air flowing in the output fiber channel from the inlet side to the outlet side is accelerated in accordance with the Venturi effect. In particular, the individual fibers feature, at the outlet side, the highest acceleration that results from this and, at the inlet side, the lowest acceleration that results from this. This difference in acceleration also leads to a drawing of the individual fibers in the output fiber channel on its way from the inlet side to the outlet side, which, for example, pulls fiber bends from the fibers, such that the quality of the yarn increases.

Moreover, it is advantageous if the output fiber channel at the outlet side has an area measuring between 10 $mm^2$ and 30 $mm^2$. In particular, the area may measure between 18 $mm^2$ and 25 $mm^2$. For example, the output fiber channel at the outlet side may have a round cross-section with a diameter of 5.5 mm, such that the area measures 23.76 $mm^2$. Thus, the ratio of the fiber density that flows through the output fiber channel and the air flow may be advantageously determined.

An additional advantageous additional form of the invention is for the output fiber channel to have a slot-shaped cross-section perpendicular to a longitudinal axis of the output fiber channel. Herein, the slot-shaped cross-section may be formed in the second section of the output fiber channel, thus between the bend and the outlet side. In addition, the cross-section may also feature an elliptical and/or an oval cross-section. Thus, the shape of the inner wall, on which the individual fibers of the bend slide along, may be adjusted.

An advantageous version of the output fiber channel with a slot-shaped cross-section (in particular, an elliptical and/or oval cross-section) is, if the largest inner extension of the cross-section or the largest dimension of the output fiber channel, in particular of the second section, to be oriented in a manner parallel to a plane of rotation of the rotor. The rotating rotor defines a plane of rotation, which is arranged, in particular, parallel to the rotor opening and/or parallel to the rotor base. In this case, the plane of rotation is also perpendicular to the axis of rotation of the rotor. The largest inner extension of the cross-section is arranged, for example with an elliptical cross-section, along the large half-axis (and amounts to twice the large half-axis). In other words, the output fiber channel is oriented with an elliptical and/or oval cross-section in such a manner that the largest inner extension of the cross-section or the largest dimension of the output fiber channel is oriented in a manner essentially perpendicular to a central axis of the cylindrical base body. With such an arrangement, the individual fibers slide along the inner wall of the output fiber channel, in particular of the second section, on which the output fiber channel has the largest curvature. Thus, the individual fibers are compressed in this "valley" of the inner wall of the output fiber channel. This represents, for example a pre-compression, whereupon yarn formation follows in the fiber-collecting groove of the rotor. The quality of the yarn that is spun in such a manner is thereby improved.

An alternative advantageous version of the output fiber channel with a slot-shaped cross-section (in particular, an elliptical and/or oval cross-section) is for the largest inner extension of the cross-section or the largest dimension of the output fiber channel to be oriented in a manner perpendicular to the plane of rotation of the rotor. In other words, the output fiber channel is oriented with an elliptical and/or oval cross-section in such a manner that the largest inner extension of the cross-section or the largest dimension of the output fiber channel is oriented essentially in the direction of a central axis of the cylindrical base body. The largest inner extension of the cross-section and the plane of rotation are defined the same as the version just addressed. If the largest inner extension of the cross-section is perpendicular to the plane of rotation, the individual fibers slide along the inner wall, which features a minimum curvature. Thereby, the individual fibers are distributed over a larger area on the inner wall and thus experience a higher decelerating effect through the friction between the individual fibers and the inner wall. The individual fibers are thus more strongly inhibited in their acceleration, and as a result may be accelerated and drawn particularly well by the rotor wall. Thus, the straightness of the single fibers is increased, which improves the quality of the yarn.

Alternatively, the largest inner extension of the cross-section of the output fiber channel, in particular of the second section, may also be arranged obliquely to the plane of rotation of the rotor. Thereby, for example, the individual fibers are shifted along the inner wall of the output fiber channel in an axial direction of the rotor, for example, in the direction of the rotor base.

Furthermore, an open-end spinning device of a spinning machine, which features a fiber channel for guiding fibers into a rotor, is proposed. The rotor is rotatably mounted in a rotor housing. The fiber channel further comprises an input fiber channel, which is arranged in an opening roller housing, and an output fiber channel, which is arranged in a channel plate adapter that is insertable into a cover of the rotor housing. Herein, the output fiber channel is connected to the input fiber channel, such that the fibers are initially guided to the rotor through the input fiber channel and subsequently through the output fiber channel.

Herein, in accordance with the invention, the channel plate adapter is formed according to the foregoing description. Thereby, the yarn quality of the yarn exiting a rotor is improved.

An advantageous additional form of the open-end spinning device in accordance with the invention is for a transition bend to be formed between the input fiber channel and the output fiber channel. Thereby, already upon the transition from the input fiber channel to the output fiber channel, the individual fibers are guided to an inner wall of the output fiber channel. Thereupon, they experience friction and are likewise inhibited in their acceleration in the output fiber channel. Thereby, the drawing of the individual fibers is reinforced, which once again leads to higher yarn quality.

It may be advantageous if the input fiber channel and the output fiber channel enclose an angle between 155° and 180°, in particular between 170° and 180°. Thereby, the individual fibers may be guided after the transition bend to the inner wall in the proper scope. Preferably, the output fiber channel is bent with respect to the input fiber channel in the direction of rotation of the rotor. However, this does not rule out such angle being greater than 180° with some rotor diameters.

BRIEF DESCRIPTION OF THE DRAWINGS

Further advantages of the invention are described in the following embodiments. The following is shown.

DETAILED DESCRIPTION

Figure 1:
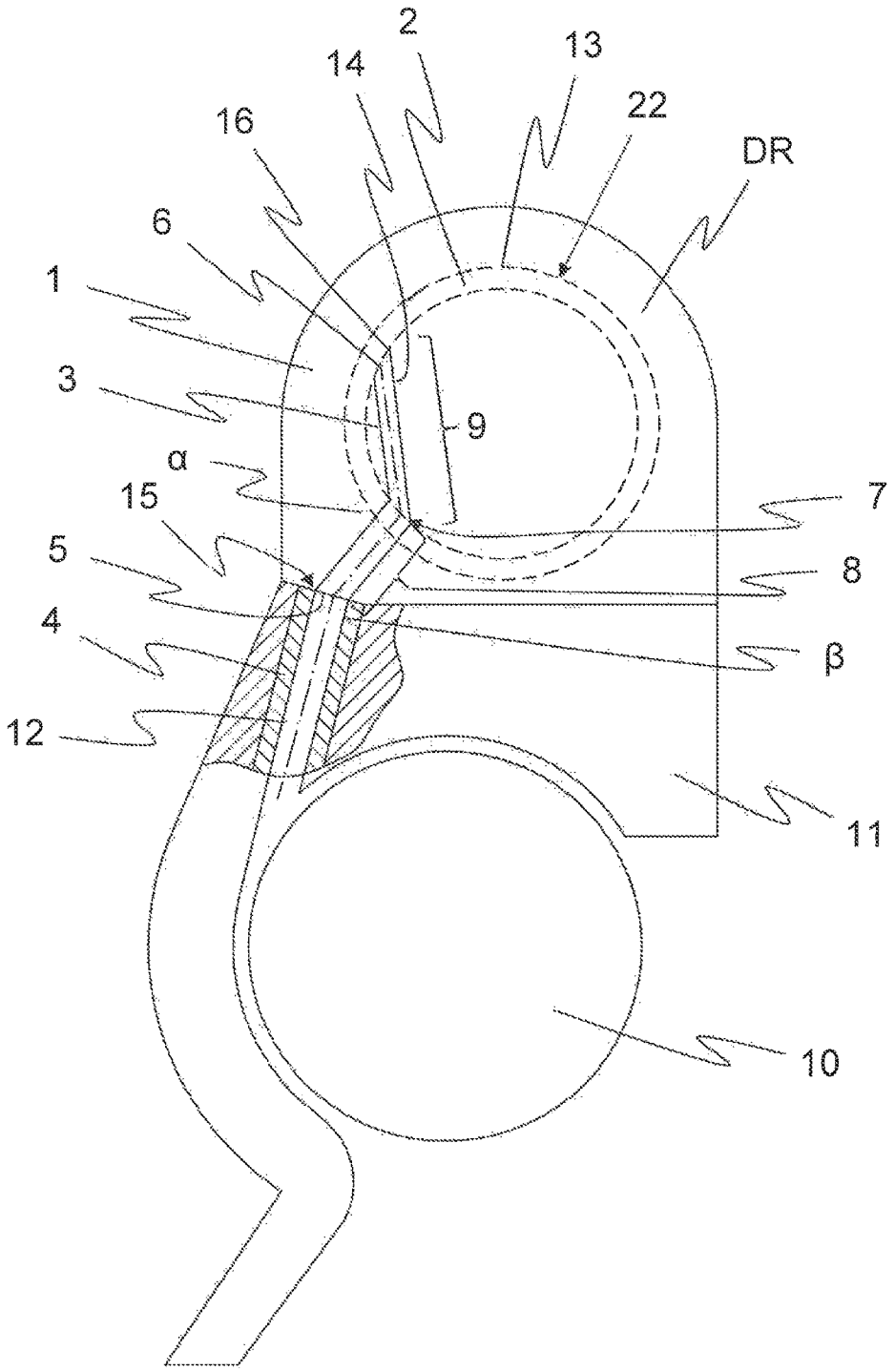
FIG. 1 is a top view of a schematic opening roller, an opening roller housing, a fiber channel and a rotor.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a top view of a schematic opening roller 10, an opening roller housing 11, a fiber channel and a rotor 2 that rotates in a plane of rotation 22. Herein, the opening roller 10 is rotatably arranged in the opening roller housing 11 and detaches a fiber strand that is not shown here, such that individual fibers are formed. In the opening roller housing 11, an input fiber channel 12 is arranged, which is preferably formed as an insert 4 that is insertable into the opening roller housing 11. A channel plate adapter 1, which features an output fiber channel 3, is attached to the opening roller housing 11, Thereby, the input fiber channel 12 transitions into the output fiber channel 3, and both together form the fiber channel, which guides the individual fibers of the opening roller 10 to the rotor 2. The output fiber channel 3 also features an inlet side 5, at which the individual fibers pass over from the input fiber channel 12 into the output fiber channel 3, and an outlet side 6, at which the individual fibers leave the output fiber channel 3 and arrive in the rotor 2.

Herein, the channel plate adapter 1 is used in a cover (not shown) of a rotor housing, which closes the rotor housing. In addition, the rotor 2 features a fiber-collecting groove 13 (see FIG. 2), in which the individual fibers slide as a result of centrifugal forces and combine to form a yarn. The rotor 2 rotates in a direction of rotation DR, and thereby generates the centrifugal forces. The finished spun yarn is guided through a draw-off element (not shown here) from the rotor 2. Thus, the quality of the individual fibers 4 guided into the rotor 2 has a significant influence on the quality of the spun yarn.

To increase the quality of the yarn, the channel plate adapter 1 in accordance with the invention features a bend 7, which is arranged between the inlet side 5 and the outlet side 6. At this, the bend splits the output fiber channel 3 into a first section 8, which is formed between the inlet side 5 and the bend 7, and a second section 9, which is formed between the bend 7 and the outlet side 6. Thus, the fibers initially flow first through the first section 8 and subsequently through the second section 9 of the output fiber channel 3. The bend 7 is formed in such a manner that the second section 9 is bent with respect to the first section 8 against the direction of rotation DR of the rotor 2. In this schematically shown version, the rotor 2 rotates clockwise, whereas the bend 7 is formed in such a manner that the second section 9 is folded counter to the clockwise direction.

Furthermore, the first section 8 with the second section 9 encloses an angle $\alpha$, which may be formed between 170° and 179°, in particular between 173° and 177°, preferably 175.6°, (it must be noted here that, in FIG. 1, for improved illustration, the angle $\alpha$ has a significantly lower value).

The bend 7 leads to the fact that, upon the transition from the first section 8 to the second section 9 of the output fiber channel 3, the individual fibers run to an inner wall 14 of the second section 9. At this, the individual fibers slide along such inner wall 14 up to the outlet side 6 of the output fiber channel 3, which is associated with friction. Due to the friction between the individual fibers and the inner wall 14, the individual fibers are inhibited in the acceleration that the rotating rotor 2 exerts on the individual fibers. If the individual fibers exit the outlet side 6 of the output fiber channel 3, they initially experience an acceleration by the rotor 2 at a front part, at which the individual fibers are directed to the fiber-collecting groove 13. The rotor 2 pulls (so to speak) the individual fibers from the output fiber channel 3. However, at a rear part, at which the individual fibers are directed away from the fiber-collecting groove 13, they are inhibited in their acceleration by the friction with the inner wall 14 of the second section 9. Such a difference between the acceleration at the front part of the individual fibers and at the rear part of the individual fibers leads to a drawing of the individual fibers 4. This drawing leads to an increase in the quality of the subsequently spun yarn.

A further effect arises from the bend 7, since, upon exiting from the outlet side 6, the individual fibers are pulled over an edge 16 of the outlet side 6. Herein, the edge 16 is arranged between the inner wall 14, on which the individual fibers slide along, and the outlet side 6. Thereby, any irregularities, such as fiber bends, arising from the individual fibers are also smoothed out.

Furthermore, a transition bend 15 is arranged between the input fiber channel 12 and the output fiber channel 3, whereas the output fiber channel 3, in particular its first section 8, with the input fiber channel 12, enclose an angle $\beta$ between 155° and 180°, in particular between 170° and 180°. Thereby, the individual fibers may be guided through the transition bend 15 at an inner wall of the first section 8 of the output fiber channel 3, such that the acceleration of the individual fibers in the output fiber channel 3 is further inhibited. Thereby, the quality of the yarn that is spun is further improved. In an alternative version of the channel plate adapter 1 and the opening roller housing 11, the input fiber channel 12 and the output fiber channel 13 could also be formed in such a manner that the angle $\beta$ has a value greater than 180°.

Figure 2:
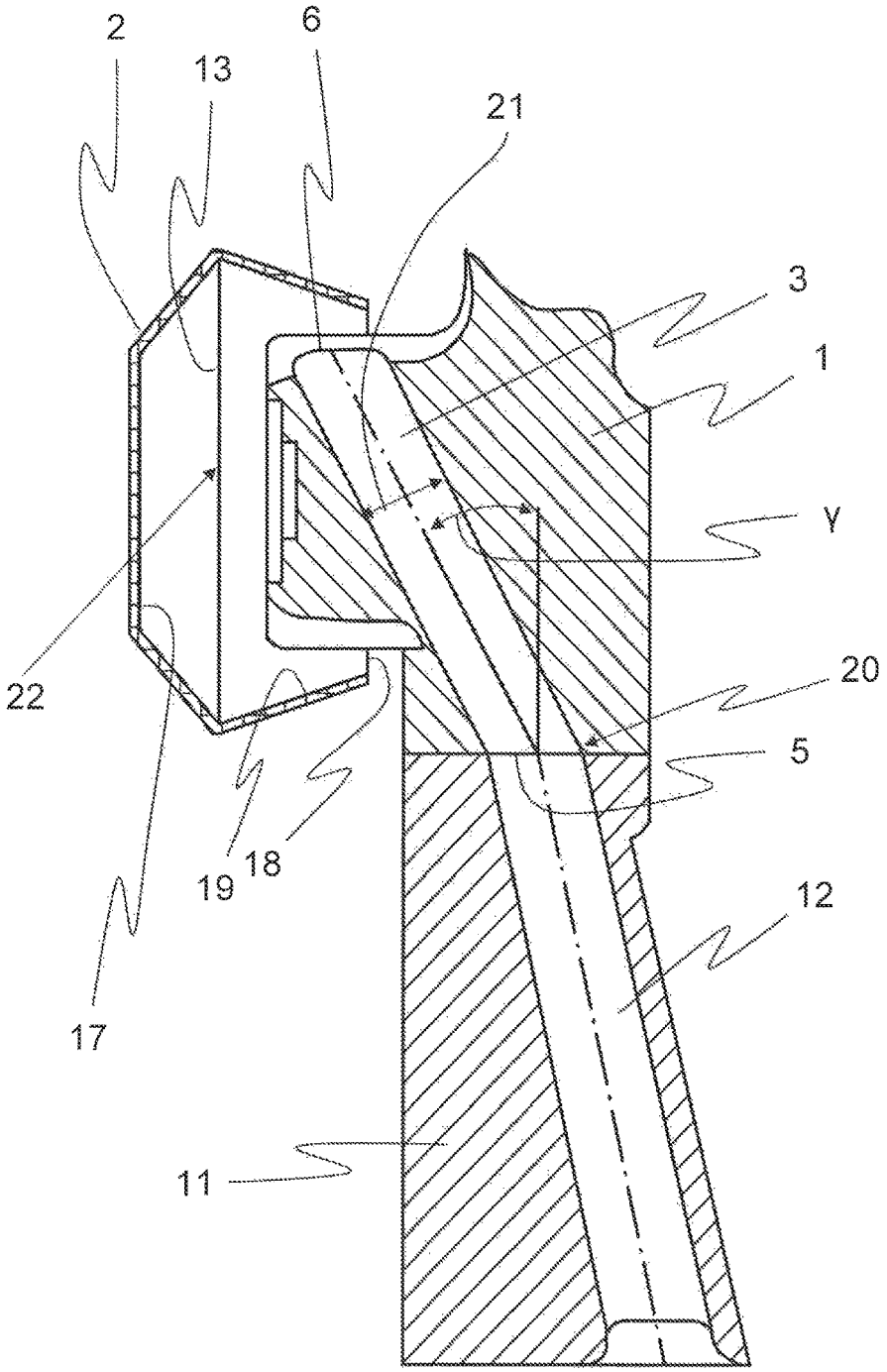
FIG. 2 is a lateral sectional view of a cover for covering a rotor housing.

FIG. 2 shows a lateral sectional view of a channel plate adapter 1 and a section of an opening roller housing 11. The channel plate adapter 1 features the output fiber channel 3, which features the inlet side 5 and the outlet side 6. Stepping out of the outlet side 6, the individual fibers exit the fiber channel output 3. One part of the channel plate adapter 1 extends through a rotor opening 18 into the rotor 2, such that the individual fibers arrive directly in the rotor 2. Upon exiting the output fiber channel 3, the individual fibers first encounter a rotor wall 19, which delimits the rotor 2 from the inside. The output fiber channel 3 has a largest inner cross-sectional diameter 21 as indicated in FIG. 2. Upon the impingement of the individual fibers on the rotor wall 19, they are accelerated, since the rotor 2 and thus the rotor wall 19 feature a higher rotational speed than the individual fibers upon exiting the output fiber channel 3. As also described in FIG. 1, the individual fibers slide on the inner wall 14 of the output fiber channel 3 along the outlet side 6. Friction arising between the individual fibers and the inner wall 14 inhibits the acceleration of the individual fibers 4. The accelerating effect of the rotor wall 19 and the acceleration-inhibiting effect of the inner wall 14 (or their friction with the individual fibers 4) leads to a drawing of the individual fibers 4, Thereby, irregularities are "drawn out of" the individual fibers. The quality of the yarn that is formed in such a manner is increased.

In addition, the output fiber channel 3 has an angle $\gamma$ in the direction of a rotor base 17. Thus, with its outlet side 6, the output fiber channel 3 is inclined to the rotor base 17. Thereby, the individual fibers are better guided into the rotor 2. In particular, this can prevent the individual fibers from escaping out of the rotor opening 18 because of the directed pulse of the individual fibers in the direction of the rotor base 17.

In this embodiment, a second bend 20 is formed between the input fiber channel 12 and the output fiber channel 3. However, such second bend 20 could also be arranged between the inlet side 5 and the outlet side 6. In particular, the second bend 20 could also be arranged at the location of the bend 7 in accordance with the invention (see FIG. 1).

If the individual fibers arrive in the fiber-collecting groove 13, they are spun into a yarn and guided out of the rotor 2 by a draw-off element (not shown).

This invention is not limited to the illustrated and described embodiments. Variations within the scope of the claims, just as the combination of characteristics, are possible, even if they are illustrated and described in different embodiments.

LIST OF REFERENCE SIGNS

1 Channel plate adapter
2 Rotor
3 Output fiber channel
4 Insert
5 Inlet side
6 Outlet side
7 Bend
8 First section
9 Second section
10 Opening roller
11 Opening roller housing
12 Input fiber channel

13 Fiber-collecting groove
14 Inner wall
15 Transition bend
16 Edge
17 Rotor base
18 Rotor opening
19 Rotor wall
20 Second bend
α Angle between the first section and the second section
β Angle between the input fiber channel and the output fiber channel
γ Angle of the output fiber channel in the direction of the rotor base

The invention claimed is:

1. A channel plate adapter for use in a cover of a rotor housing of an open-end spinning device, wherein a rotor is rotatably arranged in the rotor housing, the channel plate adapter comprising:

an output fiber channel that conveys fibers to the rotor, the output fiber channel having an inlet side where fibers enter and an outlet side from which the fibers exit towards the rotor;

the output fiber channel further comprising a bend between the inlet side and the outlet side, the bend splitting the output fiber channel into a first section formed between the inlet side and the bend, and a second section formed between the bend and the outlet side; and wherein the bend changes direction of the second section relative to the first section such that the second section is angled relative to the first section towards the rotor in a direction counter to rotation of the rotor.

2. The channel plate adapter according to claim 1, further comprising a draw-off element through which a yarn formed by the rotor is led out of the rotor.

3. The channel plate adapter according to claim 1, wherein the first section of the output fiber channel and the second section of the output fiber channel enclose an angle (α) between 170° and 179°.

4. The channel plate adapter according to claim 1, wherein the bend also orients the second section of the output fiber channel relative to the first section of the output fiber channel in a direction towards a base of the rotor.

5. The channel plate adapter according to claim 4, wherein the second section of the output fiber channel is inclined towards the rotor base at an angle between 1° and 25°.

6. The channel plate adapter according to claim 1, wherein the output fiber channel is formed in a tapered manner from the inlet side to the outlet side.

7. The channel plate adapter according to claim 1, wherein the output fiber channel comprises a cross-section area measuring between 10 $mm^2$ and 30 $mm^2$ at the outlet side.

8. The channel plate adapter according to claim 1, wherein the output fiber channel comprises a slot-shaped cross-section perpendicular to a longitudinal axis of the output fiber channel between the bend and the outlet side.

9. The channel plate adapter according to claim 8, wherein a largest inner extension of the slot-shaped cross-section of the output fiber channel is oriented parallel to a plane of rotation of the rotor.

10. The channel plate adapter according to claim 8, wherein a largest inner extension of the slot-shaped cross-section of the output fiber channel is oriented perpendicular to a plane of rotation of the rotor.

11. An open-end spinning device of a spinning machine, comprising:

a rotor, the rotor rotatably mounted in a rotor housing;

a fiber channel that guides fibers into a rotor, the fiber channel further comprising an input fiber channel arranged in an opening roller housing, and an output fiber channel arranged in a channel plate adapter that is insertable into a cover of the rotor housing; and wherein the channel plate adapter is in accordance with claim 1.

12. The open-end spinning device according to claim 11, further comprising a transition bend formed between the input fiber channel and the output fiber channel.

13. The open-end spinning device according to claim 12, wherein the input fiber channel and the output fiber channel enclose an angle (β) between 155° and 180° with the output fiber channel bent in a direction of rotation of the rotor.

* * * * *